US005545266A

United States Patent [19]

Hirosawa et al.

[11] Patent Number: 5,545,266

[45] Date of Patent: Aug. 13, 1996

[54] RARE EARTH MAGNETS AND ALLOY POWDER FOR RARE EARTH MAGNETS AND THEIR MANUFACTURING METHODS

[75] Inventors: Satoshi Hirosawa, Otsu; Hirokazu Kanekiyo, Muko, both of Japan

[73] Assignee: Sumitomo Special Metals Co., Ltd., Osaka, Japan

[21] Appl. No.: 351,184

[22] Filed: Nov. 30, 1994

Related U.S. Application Data

[63] Continuation-in-part of Ser. No. 974,235, Nov. 10, 1992, abandoned.

[30] Foreign Application Priority Data

| | | | |
|---|---|---|---|
| Nov. 11, 1991 | [JP] | Japan | 3-323779 |
| Mar. 19, 1992 | [JP] | Japan | 4-93780 |
| Apr. 16, 1992 | [JP] | Japan | 4-124180 |
| Jun. 8, 1992 | [JP] | Japan | 4-174767 |
| Jun. 9, 1992 | [JP] | Japan | 4-176199 |

[51] Int. Cl.[6] ..... H01F 1/04

[52] U.S. Cl. ..... 148/302; 420/83; 420/121; 252/62.54

[58] Field of Search ..... 148/301, 302, 148/303; 420/83, 121; 252/62.53, 62.54

[56] References Cited

U.S. PATENT DOCUMENTS

| | | | |
|---|---|---|---|
| 4,402,770 | 9/1983 | Koon | 148/302 |
| 4,881,989 | 11/1989 | Yoshizawa et al. | 148/303 |
| 5,250,206 | 10/1993 | Nakayama et al. | 420/83 |
| 5,395,462 | 3/1995 | Takeshita et al. | 148/302 |

FOREIGN PATENT DOCUMENTS

| | | | |
|---|---|---|---|
| 59-229461 | 12/1984 | Japan | 148/302 |
| 60-162750 | 8/1985 | Japan | 148/302 |

*Primary Examiner*—George Wyszomierski

*Attorney, Agent, or Firm*—Watson Cole Stevens Davis, P.L.L.C.

[57] ABSTRACT

For the purpose of establishing the manufacturing method to obtain the $Fe_3B$ type Fe—Co—B—R—M system high performance resin bonded magnet which possesses improved iHc and (BH)max and can be reliably mass produced, the specific composition of Fe—Co—B—R (Pr, Nd)—M(Ag, Al, Si, Ga, Cu, Au) type molten alloy was rapidly solidified by the melt-quenching or atomization methods, or a combination of the two methods to obtain more than 90% of the solid in an essentially amorphous structure. After the temperature was raised at the rate of 1°~15° C./min., the alloy was heat treated at 550°~730° C. for 5 minutes~6 hours to obtain Fe-rich the boron compound phase, which crystallizes the body centered tetragonal $Fe_3P$ type crystalline structure, and the $Nd_2Fe_{14}B$ type crystalline structure phase both coexisting as fine crystalline clusters of the average crystalline diameter of 5 nm~100 nm. The alloy powder which contains the ferromagnetic phase, where the boron compound phase and the $Nd_2Fe_{14}B$ type phase coexist, is combined with resin to produce the high performance resin bonded magnet with iHc≧3 kOe, Br≧5 kG, and (BH)max≧3 MGOe.

12 Claims, 2 Drawing Sheets

RARE EARTH MAGNETS AND ALLOY POWDER FOR RARE EARTH MAGNETS AND THEIR MANUFACTURING METHODS

This is a Continuation-in-part of application Ser. No. 07/974,235 filed Nov. 10, 1992, now abandoned.

TECHNICAL FIELD

This invention concerns alloy powder for rare earth resin bonded magnets and their manufacturing methods that are suitable for magnet rolls, speakers, various kinds of meters, magnets for focusing, motors, magnetic sensors, and actuators. Molten Fe—Co—B—R—M (M=Cu, Ca, Ag, Al, Si, Au) alloy of a specific composition that has a low concentration of rare earth elements is chilled by the melt-quenching method using a revolving roll, the atomizing method, or a combination of the two methods to obtain the amorphous structure. The amorphous structure is specially heat treated to obtain alloy powder of fine crystalline clusters which consist of the boron compound phase, where its main components is Fe with the tetragonal $Fe_3P$ type crystalline structure, and the $Nd_2Fe_{14}B$ type crystalline structure phase. The resultant powder is bonded by resin to obtain the residual magnetic flux density (Br) of more than 5 kG, which has been hitherto unobtainable by any hard ferrite magnet. This invention concerns the manufacturing method of such a Fe-B-R type isotropic resin bonded magnet.

BACKGROUND ART

Permanent magnets that are used for electrostatic developing magnet rolls, electric apparatus motors, and actuators were limited mainly to hard ferrite magnets; but, they suffer from problems such as low temperature demagnetizing characteristics at low temperature below iHc, and due to the nature of ceramic material, they have low mechanical strength, which is likely to result in cracking and chipping, and it is difficult to obtain a complex shape.

Today, miniaturization of household electric appliances and OA equipments has advanced, and magnet material used must be miniaturized and lightened. That is to say, in order to conserve energy, less weight of an automobile to gain better mileage is strongly sought, and the demand for miniaturization and reduction in the weight of automobile electric apparatuses.

Therefore, for the purpose of maximizing the performance to weight ratio of magnetic material, designing efforts to achieve that goal are in progress. For example, Br of 5~7 kG is considered most appropriate as magnet material in the present motor design. That is to say, in the present motor design, when Br exceeds 8 kG the cross sectional area of iron plates or rotor and stator which will become a magnetic path need to be increased, which instead will result in an increase in weight. Also, due to miniaturization of a magnet roll and a speaker, a magnet with high Br is desired, but the usual hard ferrite magnet cannot reach the residual magnet flux density (Br) in excess of 5 kG.

For example, although a Nd—Fe—B type resin bonded magnet satisfies the necessary magnetic characteristics, it contains 10–15 at % of Nd, which requires many processes and a large scale production facility in separation, purification and reduction of the metal. It is not only very expensive in comparison to hard ferrite magnet, but also it requires nearly 20 kOe of magnetizing magnetic field to magnetize 90% of the magnet, so that it is impossible to perform the complex multipolar magnetization necessary for a magnet for a magnet roll or other application such as stepping motors. At present, no one has discovered a magnet which can be economically manufactured in a large scale, has Br of 5~7 kG, and also has excellent magnetizing properties.

There are applications that demand higher B such as magnetic sensors, speakers, actuators, and stepping motors; and for these applications, the $Sm_2C_{17}$ anisotropic resin bonded magnet is presently used as the highest performing magnet, and the Nd—Fe—B isotropic resin bonded magnet as a lower cost replacement magnet. But, these magnets are still costly, and it is desired to have a low cost, easy to manufacture resin bonded magnetic material possessing high Br characteristic.

On the other hand, in the Nd—Fe—B system magnet, magnet material in which $Fe_3B$ type compound is the predominant phase in the vicinity of $Nd_4$ $Fe_{77}B_{19}$ (at %), was recently proposed, (R. Coehoorn et al., *J. de Phy.* C8, 1988, pages 669~670). This magnet material is obtained by a heat treatment of amorphous ribbons, resulting in the metastable structure which contains the crystalline cluster structure of $Fe_3B$ and $Nd_2Fe_{14}B$. Br of the metastable structure reaches even to 13 kOe, but its iHc of 2~3 kOe is not sufficiently high enough. Also, the heat treatment condition are very limited, and it is not practical for the industrial production.

Studies have been reported in which additive elements are introduced to magnet material to make it multicomponent and to improve its magnetic characteristic. One of them utilizes Dy and Tb in addition to the rare earth element, Nd, to attempt to improve iHc; however, the problem is the high cost of additive elements, and reduced magnetization due to the fact that magnetic moments of rare earth elements couple anti-parallel to magnetic moments of Nd and Fe, (R. Coehoon, *J. Magn. Magn. Mat*, 89 (1991) pages 228~230)

The other study (Shen Bao-gen, etal, *J Magn. Magn. Mat*, 89(1991) Pages 335~340) replaces a part of Fe by Co to increase curie temperature to improve the temperature coefficient of iHc, but it has the problem of reducing B with addition of Co.

In any case, the $Fe_3B$ type Nd—Fe—B system magnet is made amorphous by the melt-quenching method using a revolving roll, and heat treating it to obtain the hard magnet material. However, the resultant iHc is low, and the heat treatment condition mentioned earlier is very severe; and the attempt to increase iHc resulted, for example, in lowering the magnetic energy product, and the reliable industrial production is not feasible. Therefore, it cannot economically replace the ferrite magnet as its substitute.

This invention, focusing on the $Fe_3B$ type Fe—B—R system magnet (R=rare earth elements), by increasing iHc and (BH)max, intends to establish the manufacturing method which enables the reliable industrial production, and provide a $Fe_3B$ type Fe—B—R system resin bonded magnet with more than 5 kG of the residual magnetic flux density (Br) as an economical substitute for hard ferrite magnets.

Also, in order to provide the reliable and inexpensive $Fe_3B$ type Fe—B—R resin bonded magnet with more than 5 kG of the residual magnetic density (Br), this invention intends to provide the most suitable rare earth magnet alloy powder for resin bonded magnets and their production method.

SUMMARY OF THE INVENTION

We investigated various manufacturing methods that provide improved iHc and (BH)max of a $Fe_3B$ type Fe—B—R system magnet and its reliable industrial production. Conventionally, as far as the alloy composition is concerned, the amorphous structure was obtained by the melt-quenching method using a revolving roll. However, in the specific alloy composition where Co and other additives are added simultaneously, the amorphous structure can be obtained by a relatively slow circumferential velocity region (5~20 m/sec.) of a revolving roll. Taking advantage of this fact, we discovered the following information and completed this invention as the result of selecting one of the chilling and solidifying methods from the melt-quenching method, the gas atomization method which provides equivalent chilling speed as the melt-quenching method, and the method of spraying molten alloy particles to the revolving roll.

That is to say, after chilling the molten alloy with a low rare earth concentration and the specific composition by the melt-quenching method using the revolving roll with a relatively slow rotational speed, the gas atomizing method, or a combination of these chilling methods;

1) Adding a small amount of Co, the fluidity of the molten liquid increases remarkably, and the recovery of the chilled alloy improves; and
2) When the conversion to the amorphous phase was not complete, by administering the appropriate heat treatment, the boron compound phase which consists predominantly of iron with the same crystalline structure as $Fe_3B$, namely, the body centered tetragonal $Fe_3P$ type crystalline structure, and the intermetalic compound phase with $Nd_2Fe_{14}B$ type crystalline structure coexist in the same powder particle; and
3) Also, by adding the additive element M (M=one or two of Al, Si, Cu, Ga, Ag, and Au), when the alloy crystallizes the crystalline diameter is made finer and the appropriate chemical phases coexist in the same powder particle. Furthermore, when the average particle diameter is within the region of 5 nm~100 nm, it reaches the practically needed intrinsic coercive force of more than 2 kG; and when this alloy powder is molded into specific shapes by resin-bonding, the metastable crystalline structure does not break down near room temperature, and can be used as a usable form of permanent magnets.

This invention, making essentially more than 90% into the amorphous structure from the Fe—Co—B—R—M molten alloy using the melt-quenching method; and after raising the temperature of resultant flakes and ribbons at the rate of 1°~15° C. and heat treating them for 5 minutes to 6 hours by keeping the temperature at 550°~730° C., the fine crystalline cluster with the average crystalline diameter of 5 nm~5 nm, which consists of the ferromagnetic phase with $Nd_2Fe_{14}B$ type crystalline structures in addition to its predominant phase of the $Fe_3B$ type chemical compound phase. As a merit of limiting the rate of temperature increase, the relative abundance of these ferromagnetic phases increase while the alpha-Fe phase decreases.

Also, the effect of including at least one element of Al, Si, Cu, Ga, Ag, and Au in Fe—Co—B—R alloy, is that the magnetic characteristic of iHc≧3kOe, Br≧8 kG, and (BH)max≧8 MGOe is obtainable, by not lowering Br even with addition of Co and improving the squareness of the demagnetizing curve. Furthermore, by grinding the alloy and making it into the alloy powder for magnets, we obtained the alloy powder which is most suitable for the Fe—Co—B—R—M system resin bonded magnet with the residual magnetic flux density (Br) with more than 5 KG.

Also, in this invention, after the alloy powder is produced by the efficient gas atomizing method from the specific composition of the Fe—Co—B—R—M system molten alloy with a low concentration of rare earth elements, it is heat treated to obtain the metastable compound system which consists of the iron-rich $Fe_3B$ type compound phase, which is of the body centered tetragonal $Fe_3P$ type crystalline structure belonging to the space group $l_4$, and the $Nd_2Fe_{14}B$ type crystalline phase. In this process of obtaining the metastable mixed system, since it contains a specific amount of Co, the fine crystalline cluster of the average crystalline diameter of 5 nm~100 nm in the predominant-phase of the $Fe_3B$ type compound phase is obtained. The predominant $Fe_3B$ type compound phase and the $Nd_2Fe_{14}B$ type crystalline phase are obtained, and these ferromagnetic phases coexist in each particle in the alloy powder for resin bonded magnets. Bonding the alloy powder by resin, it is possible to obtain the resin bonded magnet with the magnetic characteristics of iHc≧3 kOe, Br≧5 kG, and (BH)max≧4 MGOe.

DETAILED DESCRIPTION OF THE INVENTION

REASONS FOR LIMITING THE COMPOSITION

Figure 1:
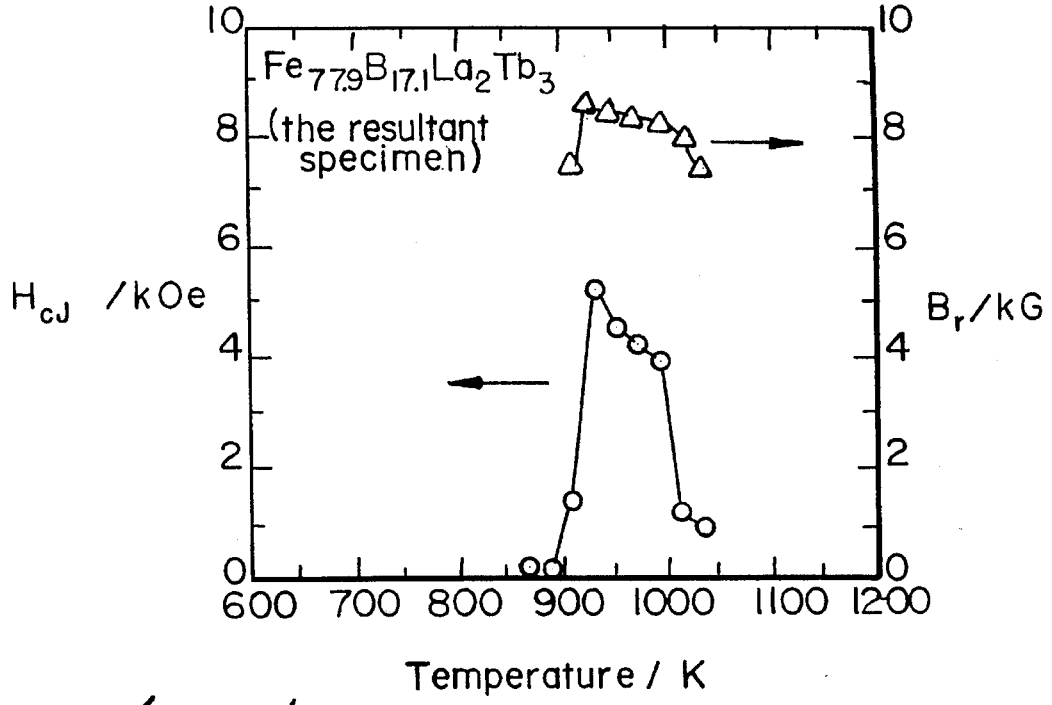
FIG. 1 is a graph showing the dependency of magnetic property on heat-treatment temperature of a prior art specimen made according to the teachings of U.S. Pat. No. 4,402,770.

In this invention, only when the rare earth element, R, is limited to one or two elements of Pr or Nd with the specified concentration, high magnetic characteristics are observed. When other rare earth elements, for example, Ce and La are used, iHc does not exceed more than 2 kOe. Also when the medium weight rare earth elements after 5 and the heavy weight rare earth elements are used, it induces degradation of the magnetic characteristic, and at the same time, resulted in the high cost magnet which is not desirable. When R is less than 3 at %, iHc could not reach more than 2 kOe; but when it exceeds 6 at %, the $Fe_3B$ phase does not grow, resulting in precipitation of the non-ferromagnetic roetastable phase of $R_2Fe_{23}B_3$, which significantly lowers iHc and is not desirable, so that the concentration is set in the range of 3–6 at %.

When B is less than 16 at % or exceeds 22 at %, iHc does not exceeds 2 kOe, so that the concentration range is set at 16~22 at %.

Co is effective in improving the squareness of the demagnetizing curve, but when it exceeds 15 at %, it remarkably decreases iHc to no more than 2 kOe, so that the concentration is set at the range of 0.05~15 at %. Al, Si, Cu, Ga, Ag, and Au improve the squareness of the demagnetizing curve by expanding the heat treatment temperature range, and increasing (BH)max. In order to have this effect, at least 0.1 at % of the additives is necessary. But when the concentration exceeds 3 at %, it degrades the squareness and lowers (BH)max. So, the concentration is set at the range of 0.1~3 at %.

Fe occupies the remainder of above mentioned elemental proportions.

REASONS FOR LIMITING THE COMPOSITION PHASE OF POWDER

The alloy powder which constitutes rare earth magnets of this invention, is characterized by having the boron compound $Fe_3B$ type phase of highly saturated magnetization of 1.6 T in which iron is the predominant element and which crystallization the body centered tetragonal $Fe_3B$ type crystalline structure, and having more than 70 vol % of the $Fe_3B$ type compound phase. This boron compound is made by replacing a part of Fe with Co in $Fe_3B$. This boron compound phase can coexist metastably under the certain range with the $Nd_2(Fe, Co)_{14}B$ ferromagnetic phase which has the $Nd_2Fe_{14}B$ type crystalline structure of the space group $P_4/mnm$.

It is necessary for the boron compound phase and the ferromagnetic phase to coexist in order to have the high magnetic flux density and sufficient iHc. Even of the same chemical composition, in the casting method the thermal equilibrium $Fe_3B$ phase possessing the C16 type crystalline structure and the body centered cubical alpha-Fe phase rather than the metastable phases are grown. In this method the high magnetization is obtained, but iHc degrades below 1 kOe and cannot be used as a suitable magnet.

REASONS FOR LIMITING CRYSTALLINE PARTICLE DIAMETER AND POWDER PARTICLE DIAMETER

In this invention, a rare earth magnet consists of the alloy powder, which in turn is made with the coexisting boron compound phase, in which $Fe_3B$ type compound with the body centered tetragonal $Fe_3B$ type crystalline structure is the main component, and the $Nd_2Fe_{14}B$ type crystalline phase coexists as another constituent phase. These phases are ferromagnetic, but the former phase by itself is magnetically soft; therefore, it must coexist with the latter phase to have the desirable iHc.

However, simply having the coexisting phases is not sufficient to provide a permanent magnet. Unless the average crystalline particle diameter is in the range of 5 nm~100 nm, the square characteristic of the demagnetization curve will deteriorate and it cannot generate the sufficient magnetic flux at the activating point. Therefore, the average crystalline particle diameter must be set at 5 nm~100 nm.

Taking advantage of a resin bonded magnet's characteristic to form complex and thin shaped magnets, it is desirable to have sufficiently small particle diameter of the alloy powder to perform the high precision molding. But the gas-atomized powder with the particle diameter exceeding 100 micro meter, because it is not sufficiently cooled crystallizes mainly in the alpha-Fe phase. Even after it is heat treated, the $Fe_3B$ type compound phase and the $Nd_2Fe_{14}B$ type compound phase did not precipitate. Therefore, it cannot become a hard magnet material.

Also, the powder particle diameter with less than 0.1 micro meter, requires a large amount of resin as a binder for its increased surface area, which results in lowering the packing density and is not desirable. Therefore, the powder particle diameter size is limited to 0.1–100 micro meter.

REASONS FOR LIMITING MANUFACTURING CONDITIONS

In this invention, the molten alloy with the above mentioned special composition is rapidly solidified either by the melt quenching method or atomizing method to transform the majority of it into the amorphous structure. After the temperature was increased at the rate of 1°~15° C./min specifically in the temperature range beginning at 500° C. or above, it is heat treated at 550°~730° C. for 5 minutes–6 hours. It is important for the fine crystalline cluster to have the thermodynamically metastable $Fe_3B$ compound phase and with the average crystalline particle diameter of 5~100 nm. As the chilling method of the molten alloy, there are the well known melt quenching method, the atomizing method, and a combination of the two methods. It is necessary to have essentially more than 90% amorphous in the rapidly solidified resultant alloy powder before the above mentioned treat treatment procedure.

For example, in the melt quenching method using a Cu roll, the roll surface rotational speed in the rage of 5~50 m/sec. produces the desirable structure. That is to say, when the rotational speed is less than 5 /sec., it does not produce the amorphous structure but the amount of alpha-Fe phase precipitates increases. When the roll surface rotational speed exceeds 50 m/sec., the chilled alloy does not form a continuous ribbon and alloy flakes scatter. It is not desirable since the alloy recovery yield and the yield efficiency decrease. If a minute amount of the alpha-Fe phase exists in the chilled ribbon, it is permissible since it does not noticeably lower the magnetic characteristic.

For example, in the gas atomization method using Ar gas as a chilling gas, it is desirable to have an injection pressure of 10~80 kgf/cm$^2$ to obtain the suitable structure and the particle size.

That is to say, if the injection pressure is less than 10 kgf/cm$^2$, the amorphous structure cannot be obtained. Not only precipitations of the alpha-Fe phase increase, but also the alloy deposits on the surface of a recovery container without sufficiently being cooled, so that the powder beads into lumps resulting in low recovery yield of the alloy. Also, when the injection pressure exceeds 80 kgf/cm$^2$, the volume fraction of powder is pulverized to the fine particle diameter of less than 0.1 micro meter increases, and not only lower the recovery yield and the recovery efficiency but also lower the pressing density, which is not desirable.

Furthermore, the chilling method which combines the melt-quenching method and the gas atomization method is suitable for the mass production. To explain it further,the molten alloy is injected against the revolving roll in the form of spray using the gas-atomizing technique. By selecting the roll surface rotational speed and the injection pressure, it is possible to obtain the desired amorphous particle diameter of alloy powder and flakes.

CONDITIONS FOR HEAT TREATMENT

In this invention, the molten alloy of the above mentioned specific composition is rapidly solidified by the melt quenching method or the atomization method, converting the majority into the amorphous solid phase. The heat treatment, that will produce the maximum magnetic characteristic, depends on the structural composition of alloy. But when the heat treatment temperature is less than 550° C., the amorphous phase remains and cannot obtain iHc of more than 2 kOe; and when the temperature exceeds 730° C., the thermodynamically equilibrium phase, the alpha-Fe phase and the $Fe_2B$ or the $Nd_{1.1}Fe_4B_4$ phase grow. Since the iHc generation will not take place in the equilibration phase mixture, the heat treatment temperature is limited to 550°–730° C. The innert gas such as Ar gas is suitable as the heat treatment atmosphere.

The heat treatment time can be short, but if it is less than 5 minutes the sufficient micro structure growth will not take place, and iHc and the squareness of the demagnetization curve deteriorate. Also, when it exceeds 6 hours, iHc with more than 2 kOe cannot be obtained. Therefore, the heat treatment holding time is limited to 5 minutes-6 hours.

As an important characteristic in this invention is the rate of the temperature increase from 500° C. and above in the heat treatment process. When the temperature increases at the rate less than 1° C./min., more than 2 kOe of iHc cannot be obtained, since iHc deteriorates from the too large crystalline diameter of the $Nd_2Fe_{14}B$ phase and the $Fe_3B$ phase. Also, when the increasing rate of the temperature exceeds 15° C./min., the growth of the $Nd_2Fe_{14}B$ phase which takes place above 500° C. does not sufficiently precipitate, but the alpha-Fe phase precipitation increases: As a result, it lowers magnetization in the 2nd quadrant of the demagnetization curve near the Br point. It also degrades (BH)max which is not desirable. However, a minute amount of the alpha-Fe phase is permissible. Moreover, in the heat treatment prior to the temperature of 500° C., any rate of the temperature increase is acceptable including the rapid heating.

METHOD OF MAGNETIZATION

In order to magnetize the invented alloy powder for rare earth magnets, which is obtained in such a way that the average crystalline particle diameter is 5 nm~100 nm, the powder is modified to fall in the average powder particle diameter of the alloy 0.1~500 micro meter range by, if necessary, grinding when combination of gas atomized and melt spinning is used, the grinding process may not be necessary. Then the powder is mixed with well known resin to make a resin bonded magnet, which has the residual magnetic flux density (Br) exceeding 5 kG.

The resin bonded magnet obtained in this invention is an isotropic magnet, and it can be manufactured by any of the methods described below such as the compression molding, the injection molding, the extrusion molding, the roll molding, and the resin impregnation.

In the compression molding, after thermosetting plastics, coupling agent, and lubricant are added to the magnet powder and mixed, it is compression molded and heated to cure the resin to obtain resin bonded magnets.

In the injection molding, the extrusion molding, and roll molding, and after thermoplastic resin, coupling agent, lubricant are added to the magnet powder and mixed, it is molded by one of the molding methods such as the injection molding, the extrusion molding, and the roll molding.

In the resin impregnation method, after the magnet powder is compressed and heated if appropriate, it is impregnated by thermosetting plastics, and heated to cure the resin. Also, resin bonded magnet is obtained by compress molding, heat treating it when appropriate (namely, when the rapidly solidified powder is directly compressed), and impregnating the magnet powder by thermoplastic resin.

In this invention, the weight proportion of the magnet powder in the resin bonded magnet, which is different from the afore mentioned manufacturing method, is 70~99.5 wt % and the remainder is 0.5~30% of resin and others. In the compression molding, the weight proportion of magnet powder is 95~99.5 wt %; in the injection molding, the packing rate of magnet powder is 90~95 wt %; in the impregnation molding, the weight proportion of magnet powder is 96~99.5%.

Synthetic resin, which is used as a binder can be thermosetting or thermoplastic, but thermally stable resin is preferred, and it can be appropriately selected from the polyamide, polyamide, phenol resin, fluoride resin, silicon resin and epoxy resin.

BEST MODE FOR CARRYING OUT THE INVENTION

EXAMPLE 1

To obtain the chemical composition of No. 1~13 in the Table 1, using more than 99.5% pure Fe, Co, B, Nd, Pr, Ag, Al, Si, Cu and Ga metals so that the total weight is 30 g, metals are set in to a quartz crucible with an orifice of 0.8 mm diameter at the bottom. It is melted under 56 cmHg of the Ar atmosphere by high frequency induction heating, and after the molten temperature reached 1400° C., the molten metal was poured by the Ar gas pressure from a height of 0.7 mm against the outer surface of a Cu roll which is rotating at high speed of 20 m/sec. at room temperature to produce the melt quenched ribbon with the width of 2~3 mm and the thickness of 30~40 micro meter.

We confirmed that the melt quenched ribbon was of the amorphous structure by the powder X ray diffraction method using the characteristic X ray of Cu—K—alpha.

After this melt-quenched ribbon was rapidly heated to 500° C. under the Ar gas atmosphere, the temperature was raised at the rates indicated in the Table 1, and the heat treatment temperature indicated in the Table 1 was kept for 10 minutes, then the temperature was brought back to room temperature. From the ribbon, samples of 2~3 mm width, 30~40 micro meter thickness, and 3~5 mm length were made, and their magnetic characteristics were measured. Table 2 shows their measurement results.

Furthermore, the measurement of samples indicated that the predominant phase is a $Fe_3B$ phase, of the tetragonal $Fe_3B$ type structure crystalline structures, and also indicated the multi phase structure including the $Nd_2Fe_{14}B$ phase and alpha-Fe phase coexist. The average crystalline diameter for these crystals is less than 0.1 micro meter. Moreover, Co in these phases replaces a part of Fe, but for Ag, Al, Si, Cu and Ga, it was difficult to analyze since they are minute additives and of ultra fine crystalline structures.

Comparison 1

The melt-quenched ribbons, that are made under the same condition as in Example 1, of compositions No. 2 and No. 7 of Example 1 are rapidly heated to 500° C. in the Ar gas atmosphere, the temperature was raised at the rate of 11° C./min. above 500° C., and heat treated at 620° C. for 10 min. After the ribbons are cooled, samples are prepared under the same condition (Comparison, No. 14, No. 18) as in Example 1, and the magnetic characteristic was measured using the VSM. Table 2 shows their results.

The melt-quenched ribbons, that are made under the same conditions as Example 1, of compositions No. 2 and No. 7 of Example 1 were rapidly heated to 500° C. in the Ar gas atmosphere, the temperature was kept at 500° C. for 10 minutes for the heat treatment for the comparisons No. 15 and No. 19; and for the comparisons No. 16 and No. 20, the temperature was raised at 4° C./min. and it was kept at 750° C. for 10 minutes for the heat treatment. After a respective ribbon was cooled, the sample was prepared in the same manner as in Example 1, and the magnetic characteristic was measured using the VSM. Table 2 shows their result.

The comparison No. 15 and No. 19 showed amorphous crystalline structures, and the comparisons No. 16 and No. 20 showed the multi-phase structure where the $Fe_2B$ phase and the alpha-Fe phase coexist.

TABLE 1

| | | composition (at %) | | | | | Heating rate from 500° C. | Heat treatment temperature | Keeping time |
|---|---|---|---|---|---|---|---|---|---|
| | | R | Fe | Co | B | M | (°C./min.) | °C. | min. |
| This invention | 1 | Pr 2<br>Nd 3 | 71.0 | 5.0 | 18.5 | Ga 0.5 | 5 | 620 | 10 |
| | 2 | Nd 5 | 70.5 | 5.0 | 18.5 | Ga 1.0 | 5 | 620 | 10 |
| | 3 | Nd 5 | 71.0 | 5.0 | 18.5 | Cu 0.5 | 5 | 620 | 10 |
| | 4 | Nd 5 | 70.5 | 5.0 | 18.5 | Cu 1.0 | 5 | 600 | 15 |
| | 5 | Pr 3<br>Nd 2 | 71.0 | 5.0 | 18.5 | Cu 0.25<br>Ga 0.25 | 5 | 650 | 15 |
| | 6 | Nd 5 | 71.0 | 5.0 | 18.5 | Al 0.5 | 5 | 670 | 10 |
| | 7 | Nd 5 | 70.5 | 5.0 | 18.5 | Al 1.0 | 5 | 670 | 10 |
| | 8 | Nd 5 | 71.0 | 5.0 | 18.5 | Ag 0.5 | 5 | 600 | 10 |
| | 9 | Nd 5 | 70.5 | 5.0 | 18.5 | Ag 1.0 | 5 | 600 | 15 |
| | 10 | Nd 5 | 71.0 | 5.0 | 18.5 | Si 0.5 | 5 | 680 | 15 |
| | 11 | Nd 5 | 70.5 | 5.0 | 18.5 | Si 1.0 | 5 | 680 | 15 |
| | 12 | Nd 4 | 71.0 | 5.0 | 18.5 | Al 0.5<br>Si 1.0 | 5 | 670 | 15 |
| | 13 | Pr 3<br>Nd 2 | 71.0 | 5.0 | 18.5 | Ag 0.25<br>Al 0.25 | 5 | 650 | 15 |
| Comparison | 14 | Nd 5 | 70.5 | 5.0 | 18.5 | Ga 1.0 | 11 | 680 | 15 |
| | 15 | Nd 5 | 70.5 | 5.0 | 18.5 | Ga 1.0 | — | 500 | 10 |
| | 16 | Nd 5 | 70.5 | 5.0 | 18.5 | Ga 1.0 | 4 | 750 | 10 |
| | 17 | Nd 5 | 70.5 | 5.0 | 18.5 | 0 | 5 | 620 | 10 |
| | 18 | Nd 5 | 70.5 | 5.0 | 18.5 | Al 1.0 | 11 | 680 | 15 |
| | 19 | Nd 5 | 70.5 | 5.0 | 18.5 | Al 1.0 | — | 500 | 10 |
| | 20 | Nd 5 | 70.5 | 5.0 | 18.5 | Al 1.0 | 4 | 750 | 10 |

TABLE 2

| | | Br (kG) | iHc (kOe) | (BH)max MGOe |
|---|---|---|---|---|
| This invention | 1 | 10.0 | 4.2 | 10.5 |
| | 2 | 10.6 | 4.3 | 13.2 |
| | 3 | 10.1 | 4.1 | 11.6 |
| | 4 | 9.7 | 4.2 | 11.5 |
| | 5 | 10.0 | 4.1 | 10.0 |
| | 6 | 10.0 | 4.2 | 10.5 |
| | 7 | 10.6 | 4.3 | 13.2 |
| | 8 | 10.1 | 4.1 | 11.6 |
| | 9 | 9.7 | 4.2 | 11.5 |
| | 10 | 10.7 | 3.8 | 12.6 |
| | 11 | 11.0 | 3.7 | 12.4 |
| | 12 | 10.5 | 3.7 | 11.7 |
| | 13 | 10.0 | 4.1 | 10.0 |
| Comparison | 14 | 9.5 | 3.4 | 7.2 |
| | 15 | 9.8 | — | — |
| | 16 | 8.0 | 0.5 | 1.0 |
| | 17 | 9.3 | 4.1 | 9.5 |
| | 18 | 9.5 | 3.4 | 7.2 |
| | 19 | 9.8 | — | — |
| | 20 | 8.0 | 0.5 | 1.0 |

EXAMPLE 2

Melt-quenched ribbons obtained in Example 1, whose compositions are No. 4 and No. 9 of Table 1, after they were heat treated as in Table 1, the ribbons were ground to less than 150 micro meter in the average particle diameter. The magnet powder was mixed with epoxy resin as a binder with the proportion of 3 wt %, and a resin bonded magnet of a density of 5.8 g/cm$^3$ with a dimension of 15 mm×15 mm×7 mm was made.

The magnetic characteristics of the resin bonded magnet were as follows:

No. 4 had iHc=4.1 kOe, B=6.9 kG, and (BH)max=6.8 MGOe.

No. 9 had iHc=4.1 kOe, B=7.0 kG, and (HB)max=6.8 MGOe.

EXAMPLE 3

In order to have the compositions as in Nos. 22–27 in the Table 3, more than 99.5% purity Fe, Co, B, Nd, Pr, Al, Si, Cu, Ga, Ag, and Au metals were weighed so that the total weight was 1 kg into an alumina crucible with an orifice of 2.0 mm at the bottom, and was melted by high frequency heat under the Ar air atmosphere. When the molten temperature reached 1300° C., a plug which was placed at the orifice was removed, and the molten alloy was atomized by the 99.9% pure Ar gas injected by a gas injection nozzle with a pressure of 40 kgf/cm$^2$ to obtain the alloy powder with the particle diameter of several micro meter to 50 micro meter.

The structure of the alloy powder thus obtained was confirmed to be amorphous by means of the characteristic X ray of Cu—K—alpha After the alloy powder is rapidly heated to 500° C. under the Ar gas atmosphere, the temperature was raised at 10° C./min. above 500° C. while maintaining the heat treatment temperature indicated in Table 3, and the alloy powder was cooled to room temperature and taken out, 30 g of the powder was taken out and mixed with paraffin and heat cured. The magnetic characteristic of the sample was measured by the VSM. Table 4 shows the result.

Moreover, the result of measurement indicates that the multi-phase exists with the $Fe_3B$ phase as the predominant phase, of the tetragonal $Fe_3B$ structures, mixed with the $Nd_2Fe_{14}B$ phase and the alpha-Fe phase coexists. The average crystalline particle diameter was less than 0.1 micro meter in all phases. Furthermore, Co replaces a part of Fe in each phase; but as far as Al, Si, Cu, Ga, Ag, and Au are concerned, since these are minute additives and of ultra fine crystalline structures, they were not detectable.

TABLE 3

| No. | R | Fe | Co | B | Al | Si | Cu | Ga | Ag | Au | Heat treatment temperature |
|---|---|---|---|---|---|---|---|---|---|---|---|
| | composition (at %) | | | | | | | | | | |
| 22 | Nd 5 | 71.0 | 5.0 | 18.5 | 0.5 | — | — | — | — | — | 620° C. |
| 23 | Nd 4 | 71.5 | 5.0 | 18.5 | — | 1.0 | — | — | — | — | 670° C. |
| 24 | Nd 3 Pr 2 | 70.5 | 5.0 | 18.5 | — | — | 1.0 | — | — | — | 610° C. |
| 25 | Nd 5 | 70.5 | 3.0 | 18.5 | — | — | — | 1.0 | — | — | 620° C. |
| 26 | Nd 4.5 | 73.0 | 5.0 | 18.5 | — | — | 0.5 | — | 0.5 | — | 640° C. |
| 27 | Nd 5 | 73.5 | 1.0 | 18.5 | — | — | 1.0 | — | — | 1.0 | 620° C. |

TABLE 4

| | Br(kG) | iHc(kOe) | (BH)max (MGOe) |
|---|---|---|---|
| 22 | 9.0 | 4.2 | 9.1 |
| 23 | 9.6 | 3.7 | 9.3 |
| 24 | 8.7 | 4.2 | 8.7 |
| 25 | 9.5 | 4.3 | 9.8 |
| 26 | 10.0 | 4.1 | 10.1 |
| 27 | 9.3 | 4.2 | 9.4 |

EXAMPLE 4

To make the elemental compositions to be Nos. 28–33 in Table 5, more than 99.5% pure Fe, Co, B, Nd, Pr, Cu, Ga, Ag, Au, Al, and Si metals were weighed so that the total weight was 30 g into a quartz crucible with an orifice of 0.8 mm diameter. After it was melted by high frequency induction heating under a pressure of 56 mmHg Ar gas atmosphere and the temperature of the melt reached 1400°, the molten liquid was injected from a height of 0.7 mm against the outer surface of a Cu roll which is rotating at a high rotational speed of 20 m/sec. to obtain melt-quenched ribbons with 2~3 mm width, 30~40 micro meter thickness. From the powder X ray diffraction using characteristic X ray of Cu—K—alpha and the cross sectional SEM photograph, the majority (more than about 90 vol %) is confirmed to be amorphous.

After rapidly heating the melt-quenched ribbons to 500° C., the temperature was raised at the rate in Table 1, and the heat treatment temperature as in Table 1 was kept for 10 minutes, and the ribbons were taken out after they reached room temperature.

The sample structure was multi phased where the predominant $Fe_3B$ type phase, the $Nd_2Fe_{14}B$ type phase, and the alpha-Fe phase coexist with the average crystalline diameter of less than 0.1 micro meter. Moreover, Co replaces a part of Fe in each phase.

After grinding this ribbon into powder with the average particle diameter whose range is 23~300 micro meter particle diameter, powder with 98 wt % and epoxy resin with 2 wt % were mixed, and was compress molded under a pressure of 6 ton/cm$^2$, and cured at 150° C. to obtain a resin bonded magnet.

The density of this resin bonded magnet is 5.6 g/cm$^3$, and Table 6 shows its magnetic characteristics.

COMPARISON 2

The melt-quenched ribbon which was obtained under the same condition as in Example 4 with the composition of No. 43 was rapidly heated under the Ar gas atmosphere, the temperature was raised at 11° C./minute above 500° C., the comparison sample No. 35 was heattreated at 500° C. for 10 minutes, while for the comparison sample No. 36 the temperature was raised at 4° C./min. and heat treated at 750° C. for 10 minutes. After these sample were cooled to room temperature, they were prepared in the same manner as in Example 1 and the magnetic characteristic was measured. Table 6 shows the result.

The comparison sample No. 35 showed the amorphous structure, while No. 36 showed the multi phase structure of the $Fe_2B$ phase and the alpha-Fe phase coexisting.

TABLE 5

| | | R | Fe | Co | B | M | Heating rate (°C./min.) | treatment temperature | Heat Keeping time min. |
|---|---|---|---|---|---|---|---|---|---|
| | | Composition (at %) | | | | | | | |
| This invention | 28 | Nd 5 | 70.5 | 5 | 18.5 | Cu 1 | 5 | 600° C. | 15 |
| | 29 | Nd 5 | 70.5 | 5 | 18.5 | Ga 1 | 5 | 620° C. | 10 |
| | 30 | Nd + Pr 5 | 70.5 | 5 | 18.5 | Ag 1 | 5 | 600° C. | 15 |
| | 31 | Nd 4.5 | 73 | 3 | 18.5 | Al 1 | 7 | 670° C. | 10 |
| | 32 | Nd 4.5 | 73 | 3 | 18.5 | Si 1 | 7 | 680° C. | 10 |
| | 33 | Nd 5 | 70.5 | 5 | 18.5 | Au 1 | 5 | 610° C. | 10 |
| Comparison | 34 | Nd 4 | 77.4 | 0.1 | 18.5 | — | 11 | 680° C. | 15 |
| | 35 | Nd 5 | 71.5 | 5.0 | 18.5 | — | — | 500° C. | 10 |
| | 36 | Nd 5 | 71.5 | 5.0 | 18.5 | — | 4 | 750° C. | 10 |

TABLE 6

| | | Br k(G) | iHc (kOe) | (BH)max MGOe |
|---|---|---|---|---|
| This invention | 28 | 5.8 | 4.0 | 5.5 |
| | 29 | 6.4 | 4.1 | 6.2 |
| | 30 | 5.8 | 3.9 | 5.2 |
| | 31 | 6.9 | 3.6 | 6.7 |
| | 32 | 7.2 | 3.7 | 7.0 |
| | 33 | 5.8 | 4.1 | 5.5 |
| Comparison | 34 | 5.5 | 2.1 | 1.6 |

TABLE 6-continued

| | Br k(G) | iHc (kOe) | (BH)max MGOe |
|---|---|---|---|
| 35 | 5.6 | — | — |
| 36 | 4.9 | 0.4 | 0.6 |

COMPARATIVE EXAMPLES

The materials and methods of the present invention are compared below to material produced according to the methods of U.S. Pat. No. 4,402,770 to Koon. U.S. Pat. No. 4,402,770 discloses a magnetic alloy material represented by the formula $(M_wX_xB_{1-w-x})(R_zLa_{1-z})_y$ wherein M is selected from the group consisting of Fe, Co, and Fe-Co alloy; X is selected from the group consisting of As, Ge, Ga, In, Sb, Bi, Sn, C, Si and Al; W is from 0.7 to 0.9; x is from 0 to 0.05; y is from 0.05 to 0.15; and z is from 0 to 0.95; and the total amount of rare earth elements is more than or equal to 5 at. %. The result is hereinafter referred to as the "reference material".

To compare the reference material with the magnetic composition of the present invention, a ribbon having a composition of $(Fe_{0.083}B_{0.18})_{0.95}Tb_{0.03}La_{0.02})$ as disclosed by U.S. Pat. No. 4,402,770 was prepared. The above composition can be converted to $Fe_{77.9}B_{17.1}Tb_3La_2$ at. % for comparison purposes with the compositions of the present invention. According to the present invention, the amount of rare earth elements is less than or equal to 6 at. %.

Processes:

600 grams of the above alloy material prepared in accordance with U.S. Pat. No. 4,402,770 was melted by high frequency induction heating. The molten material was quenched by a single roll melt quenching method to produce a ribbon of amorphous structure (30 g/batch). The method comprised: depositing 30 grams of the molten material in a transparent quartz nozzle provided at its bottom with an orifice of 0.8 mm diameter; melting the deposited material again by high frequency induction heating; jetting the molten material under a jetting pressure of 0.1 kgf/cm$^2$ onto the surface of a roll rotating at a surface rotating speed Vs of 20 m/s; and quenching the jetted material to produce the ribbon. The thus produced specimen was heat-treated at a temperature of 873° K. to 1033° K. for 10 minutes under a reduced atmospheric pressure of $10^{-3}$ torr. The magnetic property of the resultant specimen was measured by a vibrating magnetometer VSM. The results of the measurements were as follows.

1. Dependency of the heat-treatment temperature on magnetic property:

The relationship between a coercive force ($H_{cj}$) and a residual magnetic flux density ($B_r$) is shown in FIG. 1. From FIG. 1, it can be seen that both the $H_{cj}$ and the $B_r$ have a maximum value at a temperature of about 933° K. This tendency has been indicated in the cited U.S. Pat. No. 4,402,770. From this, it can be assumed that the resultant specimen as mentioned above and the magnet disclosed in the cited patent are of a metallographic structure exhibiting a hard magnetic property through the similar crystallizing process. FIG. 1 shows the dependency the heat-treatment temperature has on magnetic property.

Figure 2:
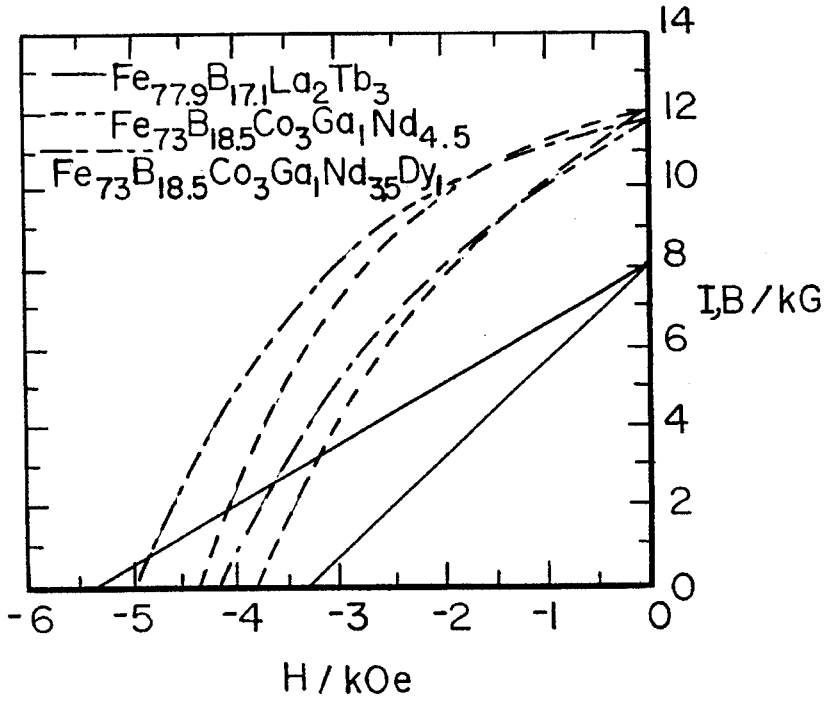
FIG. 2 is a graph showing the demagnetization curve and magnetic properties of the resultant specimen from graph 1 which was heat-treated at 933° K. for 10 minutes.

2. Magnetic property:

FIG. 2 shows the demagnetization curves of the resultant specimen which was heat-treated at 933° K. for 10 minutes. The resultant specimen has a coercive force of 5.2 kOe which is considerably higher than 3 kOe disclosed by U.S. Pat. No. 4,402,770. Although U.S. Pat. No. 4,402,770 teaches no other magnetic properties so that much of the teachings of the cited patent cannot be compared directly to many magnetic properties of the present invention, the measurement of the resultant specimen indicates a $B_r$ of 8.16 kG and a (BH) max of 6.95 MGOe, far below the minimum values afforded by the present invention.

Figure 3:
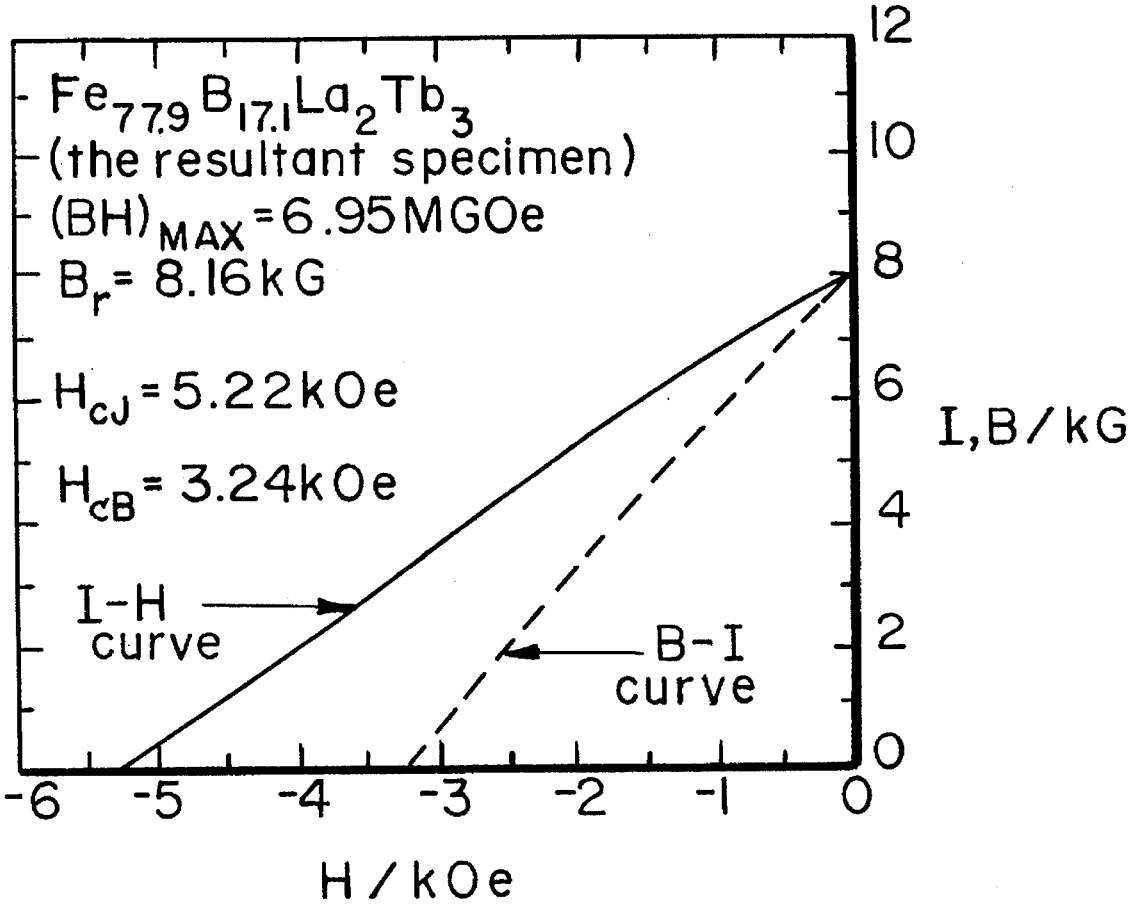
FIG. 3 is a graph showing the demagnetization curve of the resultant specimen whose properties are shown in FIG. 2, compared to the demagnetization curves of two magnet compositions in accordance with the present invention.

FIG. 3 shows the demagnetization curve of the resultant specimen in comparison with the demagnetization curves of two magnetic compositions of the present invention. From FIG. 3 it can be seen that the resultant specimen made according to the process of U.S. Pat. No. 4,402,770 is considerably inferior to the magnetic compositions of the present invention in respect of $B_r$ and the demagnetization curve.

Table 7 below shows a comparison of magnetic properties of the resultant specimen discussed above and two materials according to the present invention.

TABLE 7

| Specimen | $(BH)_{max}$(MGOe) | $B_r$(kG) | $H_{cj}$(kOe) | $H_{cB}$(kOe) |
|---|---|---|---|---|
| $Fe_{77.9}B_{17.1}Tb_3La_2$ (The resultant specimen) | 6.95 | 8.16 | 5.22 | 3.24 |
| $Fe_{73}B_{18.5}Co_3Ga_1Nd_{4.5}$ (The present invention) | 16.05 | 12.04 | 4.29 | 3.77 |
| $Fe_{73}B_{18.5}Co_3Ga_1Nd_{3.5}Dy_1$ (The present invention) | 17.14 | 11.83 | 4.93 | 4.19 |

From the foregoing it can be seen that materials according to U.S. Pat. No. 4,402,770, as far as the composition has an amount of rare earth elements which overlaps that of the present invention, the magnetic properties of the present invention, i.e., $B_r \geqq 9$ kG and $(BH)_{max} \geqq 10$ MGOe, could not be obtained. In particular, the resultant specimen is inferior in the demagnetization curve so that it is insufficient to be a material of hard magnetism which is practically usable. According to the present invention, on the other hand, the magnetic composition is of a fine metallographic structure obtained by defining the additive element M as one or two of Al, Si, Cu, Ga, Ag, and Au and by regulating the heating rate at the time of heat-treatment for crystallization. Furthermore, by enhancing the interparticle bonding between the $Fe_3B$ phase of soft magnetism and the $Nd_2Fe_{14}B$ phase of hard magnetism, the composition can be provided with an excellent demagnetization curve and a high residual magnetic flux density ($B_r$) even in the case that the amount of rare earth element is low ($\leqq$6 at. %). Consequently, the magnetic composition of the present invention is much different than that shown in U.S. Pat. No. 4,402,770.

This invention concerns rapidly solidifying the Fe—Co—B—R—M type molten alloy with the specific composition by the melt-quenching method or by the atomizing method or a combination of these two methods, transforming the bulk of it into the amorphous structure powder with the average particle diameter of 0.1–100 micro meter; after heat treating the amorphous alloy powder, magnet alloy powder of fine crystalline clusters with the average crystalline diameter of 5~100 nm is obtained. Using this method it is possible to reliably manufacture a large quantity of the Fe—Co—B—R—M system alloy magnet powder, which possesses iHc≧3 kOe, B≧8 kG, (BH)max≧8 MgOe and more than 5 kG of the residual magnetic flux density (Br), which is most suitable for resin bonded magnet.

Also, since the resin bonded magnet obtained by this invented method has a small quantity of rare earth and the manufacturing method is simple, it is suitable for a large scale manufacturing. It has more than 5 kG of the residual magnetic flux density (Br), and possesses magnetic characteristic that exceeds that of hard ferrite magnet. By utilizing the unit molding of magnetic parts and magnets, it is possible to shorten the manufacturing processes. This invention can provide resin bonded magnets that exceed sintered hard ferrite magnets in the performance to cost ratio.

What is claimed is:

1. A rare earth magnet having a compositional formula of $$Fe_{100-x-y-z}Co_xB_yR_zM_w$$

wherein R is at least one of Pr and Nd, M is one or two of Al, Si, Cu, Ga, Ag, and Au, symbols x, y, z and w each indicating a limit of composition range and respectively falling within the ranges of 0.05≦x≦15 at. %, 16≦y≦22 at. %, 3≦z≦6 at. %, and 0.1≦w≦3 at. %, said rare earth magnet including an iron-rich boron compound phase having a body-centered tetragonal $Fe_3B$ crystalline structure and a phase of $Nd_2Fe_{14}B$ crystalline structure and said rare earth magnet comprising a crystallite aggregate having an average crystalline particle diameter of 5 nm to 100 nm, said crystallite aggregate having been formed by rapidly solidifying a molten alloy by a melt quenching or gas atomizing method to cause substantially more than 90% of the solidified alloy to be amorphous, and heat-treating the rapidly solidifying alloy by raising its temperature from 500° C. at a heating rate of 1°–15° C./min and maintaining a temperature of from 550° C. to 700° C. for a period of from 5 minutes to 360 minutes, the rare earth magnet of which displays magnetic properties of iHc≧3 kOe, Br≧9 kG and (BH) max≧10 MGOe.

2. The rare earth magnet according to claim 1, wherein said rare earth magnet is a bonded magnet.

3. A rare earth bonded magnet comprising a mixture of a rare earth magnet alloy powder and a bonding resin, said rare earth magnet alloy powder having a compositional formula of $$Fe_{100-x-y-z}Co_xB_yR_zM_w$$

wherein R is at least one of Pr and Nd, M is one or two of Al, Si, Cu, Ga, Ag, and Au, symbols x, y, z and w each indicating a limit of composition range and falling within the ranges of 0.05≦x≦15 at. %, 16≦y≦22 at. % 3≦z≦6 at. %, and 0.1≦w≦3 at. %, and said rare earth magnet alloy powder including an iron rich boron compound phase having a body-centered tetragonal $Fe_3b$ crystalline structure and a phase of $Nd_2Fe_{14}B$ crystalline structure and said rare earth powder comprising a crystalline aggregate having an average crystalline particle diameter of 5 nm to 100 nm, said crystallite aggregate having been formed by rapidly solidifying a molten alloy by a melt quenching or gas atomizing method to cause substantially more than 90% of the solidified alloy to be amorphous, and heat-treating the rapidly solidifying alloy by raising its temperature from 500° C. at a heating rate of 1°–15° C./min and maintaining a temperature of from 550° C. to 700° C. for a period of from 5 minutes to 360 minutes, the rare earth magnet of which displays magnetic properties of iHc≧3 kOe, Br≧9 kG and (BH) Max≧10 MGOe.

4. The rare earth bonded magnet according to claim 3, wherein the powder has been bonded with the resin by compression molding.

5. The rare earth bonded magnet according to claim 3 comprising the alloy powder in an amount of 70 to 99.5% by weight.

6. The rare earth bonded magnet according to claim 3, comprising the alloy powder in an amount of 95 to 99.5% by weight.

7. The rare earth bonded magnet according to claim 3, comprising the alloy powder in an amount of 90 to 99.5% by weight.

8. The rare earth bonded magnet according to claim 3, comprising the alloy powder in an amount of 96 to 99.5% by weight.

9. The rare earth bonded magnet according to claim 3, wherein the powder has been bonded with the resin by injection molding.

10. The rare earth bonded magnet according to claim 3, wherein the powder has been bonded with the resin by extrusion molding.

11. The rare earth bonded magnet according to claim 3, wherein the powder has been bonded with the resin by roll molding.

12. The rare earth bonded magnet according to claim 3, wherein the powder has been bonded with the resin by resin impregnation.

* * * * *